US005411367A

United States Patent [19]

Walker

[11] Patent Number: 5,411,367

[45] Date of Patent: May 2, 1995

[54] IMPELLER ANNULAR SEAL

[75] Inventor: Craig I. Walker, Sydney, Australia

[73] Assignee: Warman International Ltd., Australia

[21] Appl. No.: 136,712

[22] Filed: Oct. 12, 1993

Related U.S. Application Data

[63] Continuation of Ser. No. 855,773, Mar. 23, 1992, abandoned.

[30] Foreign Application Priority Data

Mar. 22, 1991 [AU] Australia ..... PKS249

[51] Int. Cl.[6] ..... F04D 29/08

[52] U.S. Cl. ..... 415/170.1

[58] Field of Search ..... 415/170.1, 171.1, 172.1, 415/128, 196, 197

[56] References Cited

U.S. PATENT DOCUMENTS

| | | | |
|---|---|---|---|
| 3,221,661 | 12/1965 | Swearingen | 415/172.1 |
| 3,226,083 | 12/1965 | Braikevitch et al. | 415/198.1 |
| 3,265,002 | 8/1966 | Warman | 415/200 |
| 3,881,840 | 5/1975 | Bunjes | 415/172.1 |
| 4,432,694 | 2/1984 | Kuroda et al. | 415/172.1 |
| 4,556,364 | 12/1985 | Barker | 415/172.1 |
| 4,867,638 | 9/1989 | Handtmann et al. | 415/172.1 |

FOREIGN PATENT DOCUMENTS

| | | | |
|---|---|---|---|
| 162050 | 11/1954 | Australia | 415/172.1 |
| 972528 | 1/1951 | France . | |
| 2602846 | 2/1988 | France . | |
| 205513 | 4/1908 | Germany | 415/171.1 |
| 422681 | 12/1925 | Germany | 415/172.1 |
| 840348 | 4/1952 | Germany . | |
| 3524297 | 1/1987 | Germany . | |
| 146298 | 6/1990 | Japan . | |
| 426523 | 4/1935 | United Kingdom . | |
| 979431 | 1/1965 | United Kingdom . | |
| 2239902 | 7/1991 | United Kingdom . | |

OTHER PUBLICATIONS

"Flue-gas Desulferization And Coal's Upswing Direct Your Attention To Slurry Pumping", Power, May, 1980, vol. 124, No. 5.

*Primary Examiner*—John T. Kwon

*Attorney, Agent, or Firm*—Amster, Rothstein & Ebenstein

[57] ABSTRACT

Centrifugal pumps suffer from wear of the annular seal (1) between the impeller (2) and the casing or side liner (3), due to the returning flow of the rejoining fluid (9). The present invention ameliorates this problem by having the clearance of the annular seal (10, 11) at least adjacent the inlet (6) of the impeller (2) sloping, in the direction of the main fluid flow (7) into the impeller inlet (6), at an angle of between 0° and 60° to the axis of rotation of the impeller (2).

12 Claims, 3 Drawing Sheets

IMPELLER ANNULAR SEAL

This is a continuation of application Ser. No. 07/855,773 filed on Mar. 23, 1992, now abandoned.

The present invention relates to an impeller annular seal for centrifugal pumps for the pumping of slurries and particularly abrasive slurries. A problem in pumping slurries, containing abrasive solids in suspension, is the abrasive action of the suspended solids and the subsequent wear on the components of the pump. This subsequent wear causes enlargement of the clearances between the rotary and stationary members with a consequential leakage of the fluid pumped, back between the clearance between the annular seal, and the subsequent serious loss of head and efficiency, and the reduction in the servicable life of the wearing parts, particularly the impeller and parts of the casing or casing liners adjacent this area of the impeller.

A prior art centrifugal pump is illustrated in FIG. 1, which comprises an impeller (2) enclosed in a liner or casing (3). The impeller (2) comprises two substantially parallel rotatable members (14,15) adapted to rotate about the axis of rotation (16). A plurality of substantially radially extending primary vanes (17) extend between the members (14 & 15) from the inlet (6) of the impeller (2) to its periphery. Means commonly employed to alleviate this problem comprises a close clearance or annular seal (1), between the impeller (2) and side liners or casing (3), which acts to restrict the fluid in the high pressure area (4) at the impeller periphery from returning to the low pressure area (5) adjacent the inlet (6). The annular seal (1) is annular and concentric to the impeller eye. The subsequent wear of the components is concentrated on this annular area as a result of the high relative velocities of the returning or rejoining fluid (9) and subsequent generated turbulence.

The fluid escaping through the annular seal (1) between the impeller (2) and side liner (3) rejoins the main flow (7) of fluid travelling down the inlet of the pump into the impeller inlet (6). Because this rejoining fluid (9) has high velocity, it tends to distort the bulk of the flow into the impeller (2), leading to formation of vortices (8) and turbulence which in turn causes excessive wear on the leading edge (13), of the impeller vanes.

Many designs of annular seal exist, all with two primary aims: 1) to provide the greatest restriction to flow, and 2) to minimize wear. To this end, pumps used for pumping abrasive solids in suspension have experienced particular difficulty in achieving satisfactory wear life in this annular wear area.

The problem with prior art annular seals is that the rejoining fluid (9) joins the main flow of fluid at a large angle (usually substantially perpendicular) to this main flow (7) and in some cases is angled to flow against the direction of the main flow (7), With such a large angle, separation of the main flow (7) from the pipe wall is inevitable and a vortex (8) of high velocity fluid forms just inside the inlet (6) to the impeller (2) downstream of the annular seal (1). This formation of vortices is one of the main causes of wear at the impeller vanes leading edge (13).

Existing pumps have, as a result of this localized wear, experienced particular difficulty in achieving satisfactory life in this annular ring area surrounding the impeller eye.

The present invention seeks to ameliorate this existing problem by providing an annular seal design which minimizes overall wear on both the impeller and the adjacent liner of the centrifugal slurry pump.

In one broad form the invention comprises:

a centrifugal pump comprising:

an impeller having two substantially parallel rotatable members aligned to rotate about a common axis of rotation and defining a central intake opening in one of the rotatable members aligned along the axis of rotation, plurality of substantially radially extending primary vanes extending between the rotatable members, and extending generally radially from the axis of rotation, so as to, when said impeller is installed in a pump casing, pump liquid through the pump, and an annular area around the central intake opening of the impeller, said area having its surface at least adjacent the intake opening sloping towards the intake opening in the direction of the fluid flow at an angle from between 0° to 60° to that of the axis of rotation of the impeller; and a liner or pump casing enclosing said impeller and having an inlet aligned with the central intake opening of said one of the rotatable members, wherein the liner or pump casing has an annular area overlaying and substantially complementary in shape to the said annular area of the impeller to thereby form an annular seal of a minimal clearance between these two areas.

The present invention will now be described by way of example with reference to the following figures in which.

Figure 1:
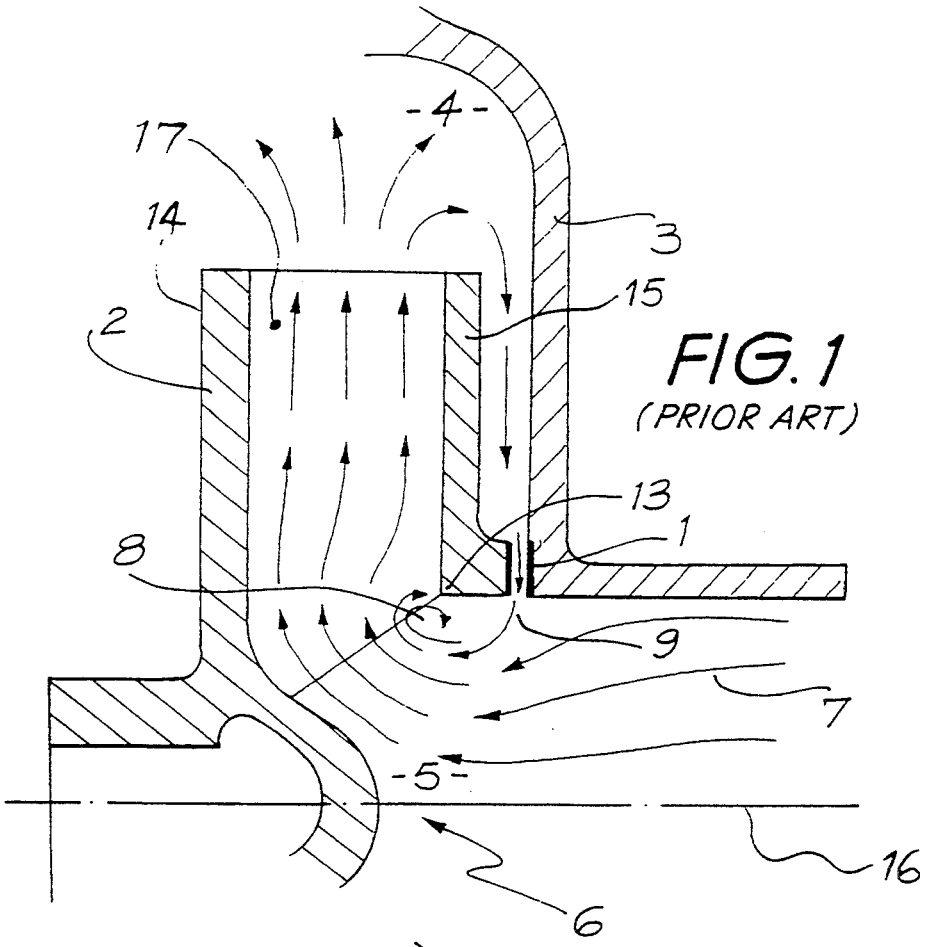
FIG. 1 (PRIOR ART)

It has been found during testing that the angle at which the returning fluid (9) rejoins the main flow (7) is critical in controlling the recirculation and subsequent wear adjacent the inlet of the impeller by the returning fluids (9) from the high pressure area (4) to the low pressure area (5) at the inlet (6) of the impeller (2).

It has been found by the inventor that by decreasing the angle of the inlet of the clearance of the annular seal (1) relative to the axis of rotation facing towards the inlet opening (6) of the impeller (2) (i.e. with the direction of flow into the impeller) that there has been a decrease in wear on the casing liner (3) and impeller (2) as opposed to the wear which occurs in prior art pumps.

Figure 2:
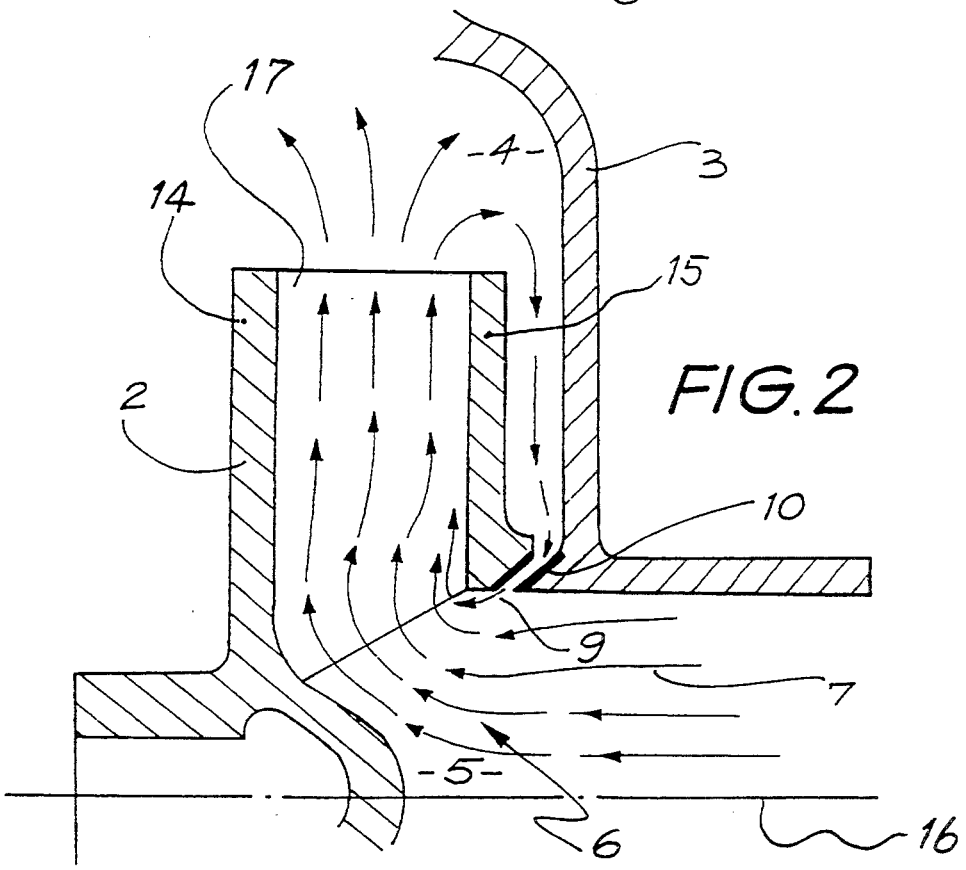
FIG. 2 illustrates a centrifugal pump according to one embodiment of the present invention.
Figure 3:
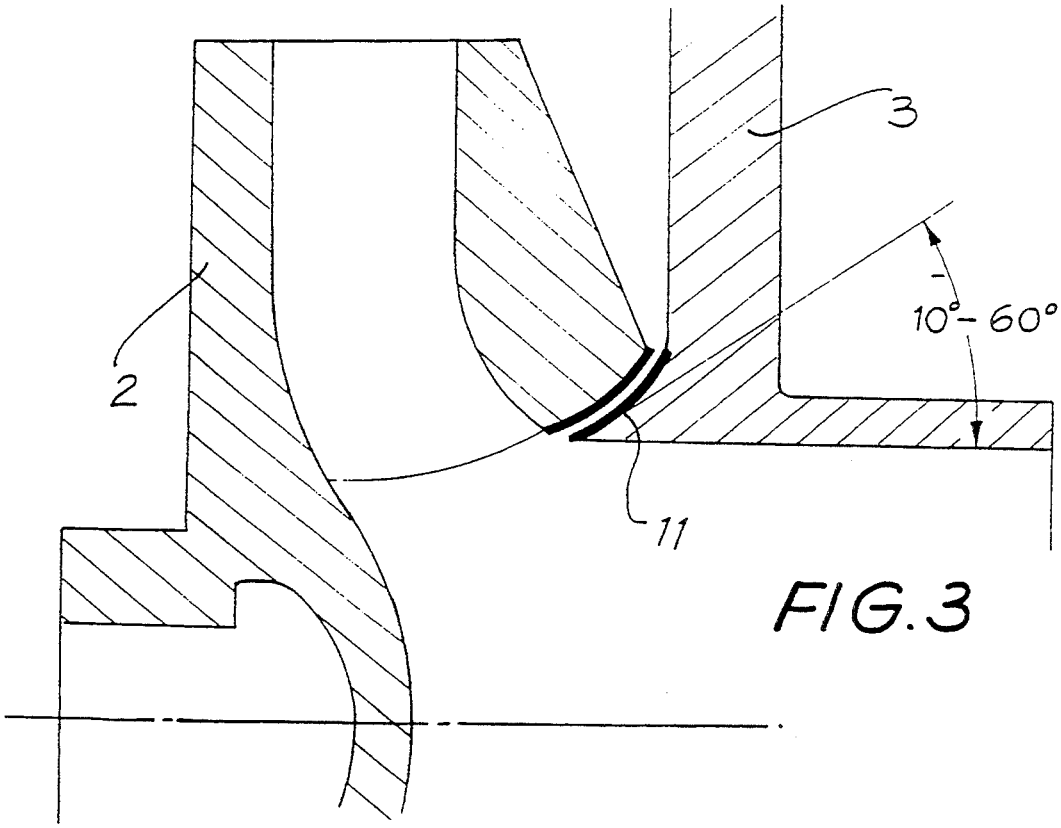
FIG. 3 illustrates a centrifugal pump according to a second embodiment of the present invention.

The profile of the clearance of the annular seal (10) and (11) can be straight, as shown in FIG. 2, or respectively curved as shown in FIG. 3, and preferably the intersecting angle of the outlet of this clearance with the intake opening is between 10° and 60°. The annular seals (1,10,11) have been highlighted for clarity sake.

Thus by reducing the angle at which the rejoining fluid (9) joins the main fluid (7), wear on the impeller (2) is greatly reduced because the main fluid (7) remains attached to the inlet pipe wall and the formation of vortices at the vane leading edge (13) is lessened or eliminated.

Experimental testing has shown that impeller wear is significantly reduced when the angle of the rejoining flow is between 10° and 60° to the axial centre line. The preferred angle being between 20° and 45°.

Figure 4:
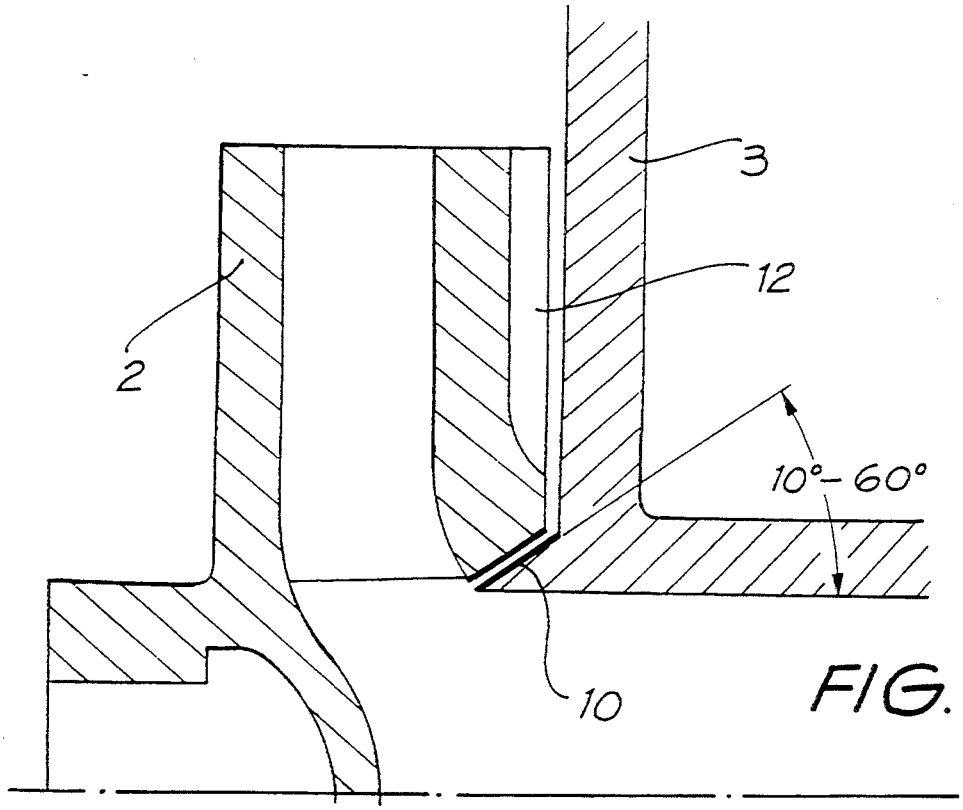
FIG. 4 illustrates a centrifugal pump according to a further embodiment of the present invention.
Figure 5:
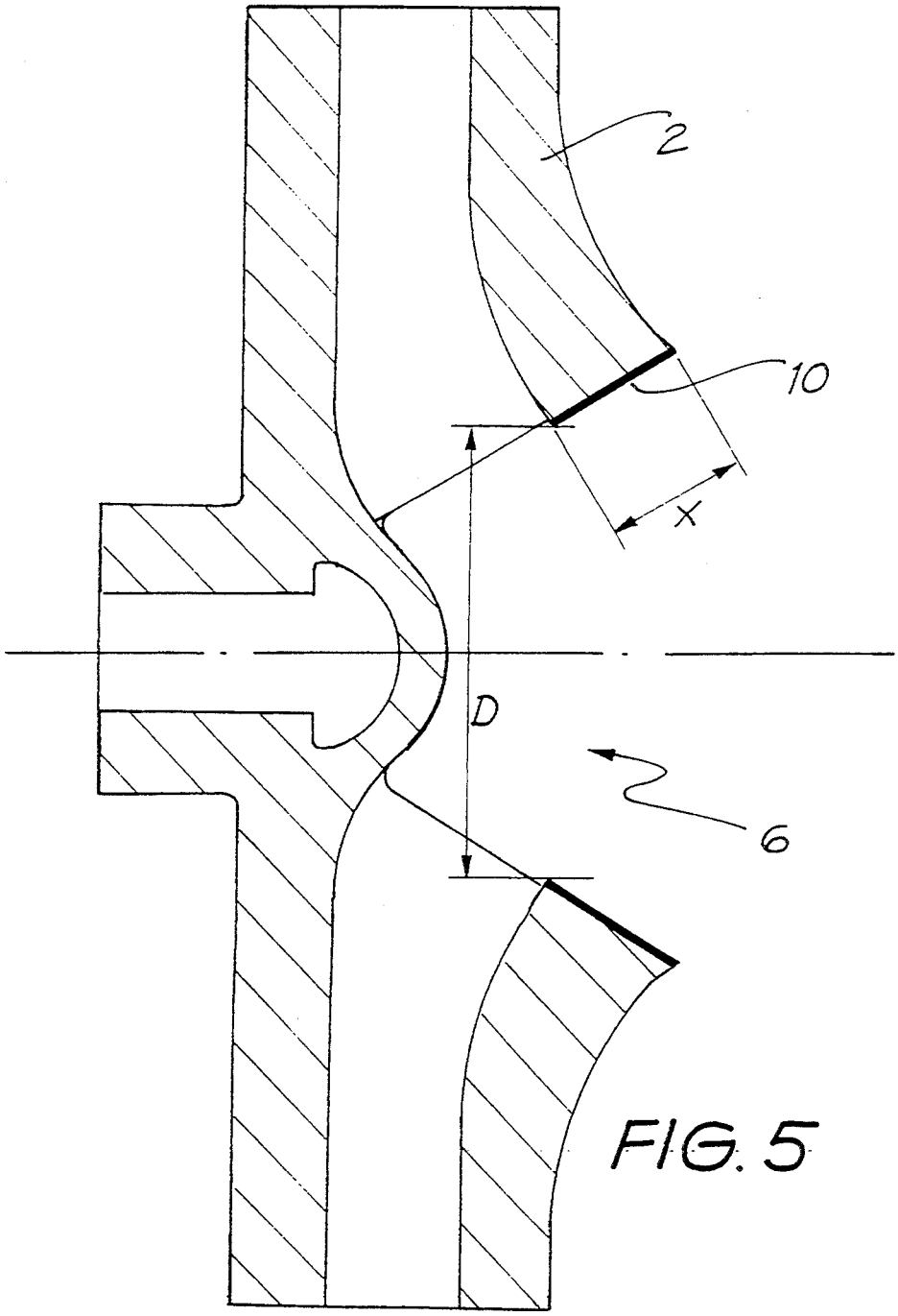
FIG. 5 illustrates an impeller according to another embodiment of the present invention.

The maximum length of the seal formed is not critical. However, as shown in FIG. 5, preferably the minimum width of the seal should not be less than 0.05 of the diameter of the intake opening (6) of the impeller (2) for effective sealing. This form of annular seal construction can be used with any other construction of the pumps including radial expelling vanes (12), as shown in FIG. 4.

It should be obvious to people skilled in the art that modifications and alterations can be made to the annular seal described in the above description without departing from the spirit and scope of the present invention.

I claim:

1. A centrifugal slurry pump comprising:

an impeller having two substantially parallel rotatable members aligned to rotate about a common axis of rotation and defining a central intake opening in one of the rotatable members aligned along the axis of rotation, a plurality of substantially radially extending primary vanes extending between the rotatable members, and extending generally radially from the axis of rotation, so as to, when said impeller is installed, pump liquid through the pump, and an annular area around the central intake opening of said impeller, said area having its surface at least adjacent the intake opening sloping towards the intake opening in the direction of the fluid flow at an angle from between 20° to 45° to that of the axis of rotation of said impeller; and a liner enclosing said impeller and having an inlet aligned with the central intake opening of said one of the rotatable members, wherein said liner has an annular area overlaying and substantially complementary in shape to said annular area of said impeller to thereby form an annual seal having a minimum width (X) of not less than 0.05 of the diameter (D) of said intake opening.

2. A centrifugal slurry pump according to claim 1 wherein said annular seal has its surface of the annular area flat in profile.

3. A centrifugal slurry pump according to claim 1 wherein said one rotatable member has expelling vanes located on its surface adjacent the liner.

4. A centrifugal slurry pump according to claim 1 wherein said annular seal has its surface of the annular area curved in profile.

5. A centrifugal slurry pump according to claim 4 wherein said annular seal has its outlet at an angle from 20° to 45° to that of the axis of rotation of the impeller, in the direction of the flow into the inlet of the impeller.

6. A centrifugal slurry pump according to claim 5 wherein said one rotatable member has expelling vanes located on its surface adjacent a liner.

7. A centrifugal slurry pump comprising:

an impeller having two substantially parallel rotatable members aligned to rotate about a common axis of rotation and defining a central intake opening in one of the rotatable members aligned along the axis of rotation, a plurality of substantially radially extending primary vanes extending between the rotatable members, and extending generally radially from the axis of rotation, so as to, when said impeller is installed in a pump casing, pump liquid through the pump, and an annular area around the central intake opening of said impeller, said area having its surface at least adjacent the intake opening sloping towards the intake opening in the direction of the fluid flow at an angle from between 20° to 45° to that of the axis of rotation of said impeller; and a pump casing enclosing said impeller and having an inlet aligned with the central intake opening of said one of the rotatable members, wherein said pump casing has an annular area overlaying and substantially complementary in shape to said annular area of said impeller to thereby form an annular seal having a minimum width (X) of not less than 0.05 of the diameter (D) of said intake opening.

8. A centrifugal slurry pump according to claim 7 wherein said annular seal has its surface of the annular seal flat in profile.

9. A centrifugal slurry pump according to claim 7 wherein said one rotatable member has expelling vanes located on its surface adjacent the casing.

10. A centrifugal slurry pump according to claim 7 wherein said annular seal has its surface of the annular area curved in profile.

11. A centrifugal slurry pump according to claim 10 wherein said annular seal has its outlet at an angle from 20° to 45° to that of the axis of rotation of the impeller, in the direction of the flow into the inlet of the impeller.

12. A centrifugal slurry pump according to claim 11 wherein said one rotatable member has expelling vanes located on its surface adjacent the casing.

* * * * *